US006626739B1

(12) United States Patent
Wada et al.

(10) Patent No.: US 6,626,739 B1
(45) Date of Patent: Sep. 30, 2003

(54) POLISHING METHOD AND POLISHING APPARATUS

(75) Inventors: Yutaka Wada, Chigasaki (JP); Hirokuni Hiyama, Tokyo (JP); Kazuto Hirokawa, Chigasaki (JP); Hisanori Matsuo, Fujisawa (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/640,981

(22) Filed: Aug. 18, 2000

(30) Foreign Application Priority Data

Aug. 18, 1999 (JP) ..... 11-231924

(51) Int. Cl.[7] ..... B24B 5/00

(52) U.S. Cl. ..... 451/41; 451/57; 451/443; 451/285

(58) Field of Search ..... 451/41, 67, 285–290, 451/443, 444, 56, 36, 57, 58, 211, 241, 270, 271; 51/131.1, 283 R; 156/636.1, 645.1, 655.1, 656.1

(56) References Cited

U.S. PATENT DOCUMENTS

| | | | | | |
|---|---|---|---|---|---|
| 5,216,843 | A | * | 6/1993 | Breivogel et al. | 451/285 |
| 5,554,064 | A | | 9/1996 | Breivogel et al. | |
| 5,643,067 | A | * | 7/1997 | Katsuoka et al. | 451/211 |
| 5,725,417 | A | | 3/1998 | Robinson | |
| 5,738,574 | A | | 4/1998 | Tolles et al. | |
| 5,769,697 | A | * | 6/1998 | Nishio | 451/285 |
| 5,779,521 | A | * | 7/1998 | Muroyama et al. | 451/287 |
| 5,782,675 | A | | 7/1998 | Southwick | |
| 5,839,947 | A | * | 11/1998 | Kimura et al. | 451/287 |
| 5,857,898 | A | * | 1/1999 | Hiyama et al. | 451/287 |
| 5,879,226 | A | | 3/1999 | Robinson | |
| 5,934,980 | A | * | 8/1999 | Koos et al. | 438/692 |
| 6,036,582 | A | * | 3/2000 | Aizawa et al. | 451/288 |

FOREIGN PATENT DOCUMENTS

| | | |
|---|---|---|
| EP | 0807492 A2 | 11/1997 |
| JP | 8-22970 | 1/1996 |
| WO | 99/08837 | 2/1999 |
| WO | WO99/55493 | 4/1999 |
| WO | 99/26763 | 6/1999 |

* cited by examiner

*Primary Examiner*—Joseph J. Hail, III
*Assistant Examiner*—Anthony Ojini
(74) *Attorney, Agent, or Firm*—Wenderoth, Lind & Ponack, L.L.P.

(57) ABSTRACT

A method is provided for polishing a device wafer, which has projections and depressions formed on a surface thereof, with the use of an abrading plate. The method comprises polishing the device wafer while supplying a surface active agent and/or while dressing a surface of the abrading plate. This method for polishing the device wafer can always exhibit a self-stop function, without being restricted by the composition of the abrading plate, and without being restricted by the type of the substrate.

23 Claims, 16 Drawing Sheets

POLISHING METHOD AND POLISHING APPARATUS

BACKGROUND OF THE INVENTION

1. Field of the Invention

This invention relates to a polishing method and a polishing apparatus which use an abrading plate (fixed abrasive polishing tool). More particularly, the invention relates to a method and an apparatus for polishing an object to be polished, such as a semiconductor wafer, in a flat and mirror-like state.

2. Description of the Related Art

In recent years, with the increased integration of semiconductor devices, interconnection of circuits has become miniscule, and the devices to be integrated have been miniaturized. This may require the step of removing a film, formed on the surface of a semiconductor wafer, by polishing to flatten the surface. As means of this surface-flattening or planarization, polishing by means of a chemical and mechanical polishing (CMP) device is performed. This type of CMP device has a turntable pasted with a polishing cloth (pad), and a top ring. An object to be polished is interposed between the turntable and the top ring. With the turntable being kept under a constant pressure from the top ring, and the polishing cloth being supplied with a polishing solution (slurry), the turntable and the top ring rotate to polish the surface of the object to be polished into a flat, mirror-like form.

The above-described CMP process using a polishing solution (slurry) performs polishing while supplying a relatively soft polishing cloth with the polishing solution (slurry) containing a large amount of abrasive particles. Thus, this process is problematic in terms of pattern dependency. Pattern dependency refers to the fact that an irregular pattern on the semiconductor wafer, which has existed before polishing, results in the formation of mild irregularities after polishing, thus making it difficult to obtain perfect flatness. That is, irregularities with small pitches lead to a high polishing speed, while irregularities with large pitches lead to a low polishing speed, with the result that the fast polishing portions and the slow polishing portions together result in the formation of the mild irregularities. Besides, the polishing process using the polishing cloth (pad) polishes both the projections and the depressions of the irregularities, thus posing difficulty in achieving a so-called self-stop function, i.e., the function that only the projections are polished away to bring complete flatness, and at this time, polishing stops.

On the other hand, study is under way about polishing of a semiconductor wafer using so-called fixed abrasive particles (an abrading plate), i.e., abrasive particles, such as cerium oxide ($CeO_2$), fixed with the use of a binder, such as phenol resin. Polishing with such an abrading plate is advantageous in the following respects: The abrading plate is hard unlike that in conventional CMP. Thus, the projections of the irregularities are polished preferentially, while the depressions of the irregularities are polished with difficulty, so that absolute flatness is easy to obtain. Depending on the composition of the abrading plate, moreover, the self-stop function emerges in the following manner: Polishing of the projections is completed to impart a flat surface. At this time, the polishing speed markedly lowers, and polishing actually does not proceed any more. In addition, polishing with an abrading plate does not use a polishing solution (slurry) containing a large amount of abrasive particles, thus conferring the advantage that the burden of an environmental problem is lessened.

Polishing using an abrading plate, however, poses the following problems: If the composition of the abrading plate is such that the binding force of a binder for binding abrasive particles is high, the abrasive particles minimally exhibit a self-generating effect during polishing. Immediately after dressing, a relatively high polishing speed is obtained. However, as polishing proceeds, the polishing speed decreases, failing to obtain a sufficient polishing speed. In the case of an abrading plate with a low binding force of a binder for binding abrasive particles, the abrading plate is brittle as a whole. Since the abrasive particles easily self-generate, a relatively high polishing speed is obtained. However, not only the projections, but the depressions of the irregularities of the surface of workpiece are also polished. After polishing, a completely flat surface is difficult to obtain, arousing a problem with so-called step characteristics. In addition, such an abrading plate minimally achieves the self-stop function by which progress of polishing automatically stops after polishing of only the projections is completed.

Hence, an abrading plate showing the self-stop function is in a relatively narrow range in which the proportions of a binder, abrasive particles, and pores are well balanced. Such an abrading plate does not necessarily provide the desired polishing speed stability and step characteristics for the object to be polished. Materials to be polished range widely, including silicon substrates, polysilicon films, oxide films, nitride films, and interconnection layers comprising aluminum or copper materials. Producing abrading plates, which have stability of polishing speed, satisfactory step characteristics, and self-stop function in response to these various objects to be polished, has been very difficult.

It may be desired to enclose a third substance in an abrading plate in order to decrease scratches or promote the reaction. Enclosure of such a substance, however, changes the composition conditions, and results in the failure to exhibit the self-stop function.

In addition, the polishing speed during polishing of a semiconductor wafer by use of an abrading plate is high immediately after dressing. However, the polishing speed gradually decreases, so that the polishing speed is not stable. To stabilize the polishing speed, dressing needs to be performed before each polishing. Dressing before each polishing requires a certain period of time. Thus, a throughput declines in practical use, and its decline lowers productivity.

SUMMARY OF THE INVENTION

The present invention has been accomplished in light of the foregoing circumstances. Its object is to provide a method and apparatus for polishing a substrate, which can always exhibit the self-stop function, without being restricted by the composition of the fixed abrasive, and without being restricted by the type of the substrate to be polished.

A first aspect of the invention is a method for polishing a device wafer by use of a fixed abrasive, the device wafer having projections and depressions formed on a surface thereof. The method comprises polishing the device wafer while supplying a surface active agent and/or while performing dressing of a surface of the fixed abrasive.

When polishing is performed while a surface active agent is being supplied, polishing of a blanket wafer (a wafer with a flat surface without irregularities) is known to proceed minimally. That is, the supply of a surface active agent enables the self-stop function to be exhibited. To carry out polishing while dressing the fixed abrasive surface, moreover, causes a large amount of free abrasive particles to be always self-generating during polishing, thus stabilizing the polishing speed. To perform polishing, while supplying a surface active agent and performing dressing, therefore, can present many free abrasive particles, obtain a relatively high polishing speed, and show the self-stop function. Accordingly, the self-stop function can be shown in a wide range of compositions for a fixed abrasive, without restriction by the conventional composition conditions for the fixed abrasive.

The method for polishing a device wafer may comprise continuing polishing while starting supply of the surface active agent, before polishing of the device wafer proceeds to flatten the projections. According to this feature, supply of the surface active agent is started before polishing of the device wafer proceeds to flatten the projections, for example, when 2T/3 has passed, provided that the time required until flattening is T. By this measure, the self-stop function can be exhibited efficiently. That is, supply of the surface active agent is not performed at an initial stage, but rather at an intermediate stage of polishing. The amount of the surface active agent to be otherwise used in these stages can be saved, whereby the cost for polishing can be decreased.

The method for polishing a device wafer may comprise polishing the device wafer while dressing the fixed abrasive, and stopping dressing and continuing only polishing, before polishing of the device wafer proceeds to flatten the projections. According to this feature, dressing is stopped before the projections of the device wafer are flattened, for example, when 2T/3 has passed, provided that the time required until flattening is T. By this measure, the amount of free abrasive particles exhibiting a self-generating effect can be decreased. Thus, the polishing speed lowers, and the self-stop function can be exhibited. Therefore, the range in which the self-stop function appears can be widened by polishing with a fixed abrasive, without the use of chemicals, such as surface active agents.

The method for polishing a device wafer may comprise performing polishing while supplying a chemical solution contributing to promotion of a reaction. According to this feature, it becomes possible to increase the polishing speed without using dressing, and stabilize the polishing speed.

The method for polishing a device wafer may comprise polishing the device wafer by use of the fixed abrasive, and then performing touch-up polishing of the device wafer. According to this feature, abrasive particles deposited on the surface of the wafer, and flaws (scratches) on the wafer surface can be removed.

A second aspect of the invention is an apparatus for polishing a device wafer by use of a fixed abrasive, the device wafer having projections and depressions formed on a surface thereof. The apparatus comprises means for promoting polishing, and means for suppressing polishing.

The means for promoting polishing is preferably dressing means for performing dressing during polishing, or means for supplying a chemical solution for promoting polishing. The means for suppressing polishing is preferably means for supplying a surface active agent.

The size of the wafer, which is an object to be polished, and the size of the table-shaped fixed abrasive may be in the following relationship $$2Rw>Rf>Rw/2$$

where Rw is the radius of the wafer, and Rf is the radius of the table-shaped fixed abrasive. And, the wafer rotates on its own axis, and the fixed abrasive rotates on its own axis.

According to these features, some variation in the relative speed occurs in the polished surface of the device wafer to be polished, relative to the polishing surface of the fixed abrasive. Because of the above-described self-stop function, however, once the projections are flattened, progress of polishing stops. As a result, a uniform flat surface is obtained. Thus, the diameter of the table-shaped fixed abrasive relative to the diameter of the wafer can be reduced compared with earlier technologies. Consequently, the apparatus and the fixed abrasive can be made compact and economical, without deterioration of polishing performance.

A third aspect of the invention is an apparatus for polishing a device wafer by use of a fixed abrasive, wherein the device wafer has projections and depressions formed on a surface thereof. The apparatus comprises: means for promoting polishing; and means for suppressing polishing: and wherein a size of the wafer, which is an object to be polished, and a size of the table-shaped fixed abrasive are in the following relationship $$2Rw>Rf>Rw/2$$

where Rw is a radius of the wafer, and Rf is a radius of the table-shaped fixed abrasive. The radius Rf of the table-shaped fixed abrasive is greater than a distance between a center of the wafer and a center of the table-shaped fixed abrasive. The wafer rotates on its own axis, and the fixed abrasive rotates on its own axis.

According to these features, some variation in the relative speed occurs in the polished surface of the substrate to be polished, corresponding to the polishing surface of the fixed abrasive. Because of the above-described self-stop function, however, once the projections are flattened, progress of polishing stops. Even if the polished surface of the substrate to be polished leaves the polishing surface of the fixed abrasive, the inclination of the top ring is suppressed, because the center of gravity of the wafer always lies on the table-shaped fixed abrasive. As a result, a uniform flat surface can be obtained. Thus, the diameter of the table-shaped fixed abrasive relative to the diameter of the wafer can be reduced compared with earlier technologies. Consequently, the apparatus and the fixed abrasive can be made compact and economical without deterioration of polishing performance.

The apparatus for polishing a device wafer may further comprise touch-up devices for performing touch-up polishing of the device wafer for which polishing has been performed by use of the fixed abrasive. This feature makes it possible to remove abrasive particles deposited on the surface of the wafer, and flaws (scratches) on the wafer surface caused by fixed abrasive polishing.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIGS. 3A to 3C are views showing parameters of polishing accompanied by dressing at a low dressing surface pressure, in which FIG. 3A shows the relationship between the polishing time and the film thickness, FIG. 3B shows the relationship between the surface active agent concentration and the polishing speed, and. FIG. 3C shows the polishing speeds during pattern polishing, after elimination of steps, and blanket wafer polishing;

DETAILED DESCRIPTION OF THE PREFERRED EMBODIMENTS

Preferred embodiments of the present invention will now be described in detail with reference to the accompanying drawings. In the embodiments described below, the term "abrading plate" is used. Abrading plate is one type of a fixed abrasive. An abrading plate is made of abrasive particles and binder binding the abrasive particles and is formed as a circular disk plate. Other fixed abrasives include a fixed abrasive pad wherein a thin fixed abrasive layer is bonded on a soft elastic layer.

Figure 1A:
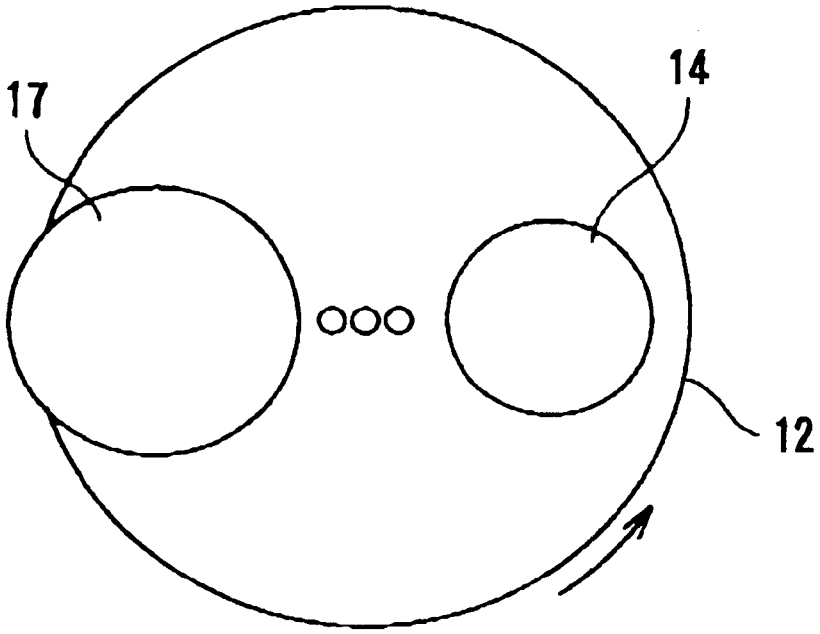
FIGS. 1A and 1B are a plan view and a sectional view, respectively, of a polishing apparatus according to an embodiment of the invention.
Figure 1B:
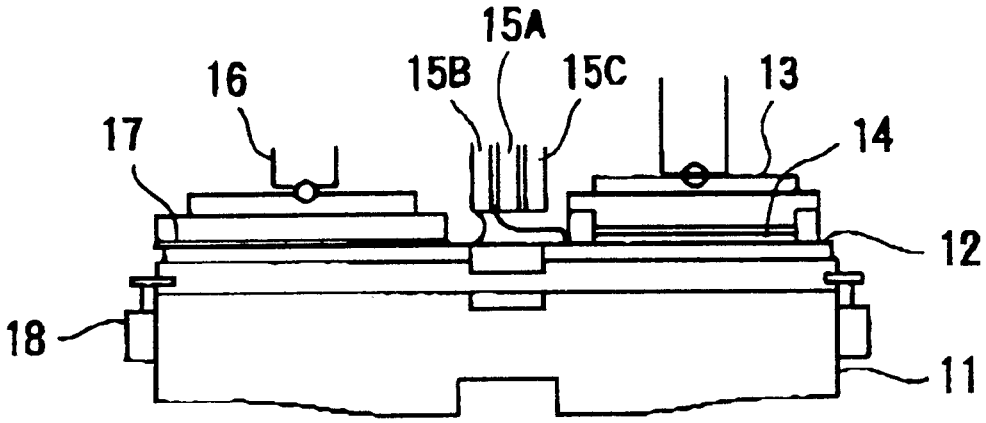

FIGS. 1A and 1B show a polishing apparatus according to an embodiment of the present invention. To a turn table 11, an abrading plate 12 is fixed by a clamp 18. As stated earlier, the abrading plate 12 is composed of a composition comprising abrasive particles, a binder, and pores, which is preferred for polishing a device wafer having various semiconductor circuit patterns formed thereon. A top ring 13 holds a semiconductor wafer 14, a substrate to be polished, by means of vacuum attraction. The top ring 13 presses a surface of the semiconductor wafer 14 to be polished against a polishing surface of the abrading plate 12 while rotating. Thus, the surface of the wafer 14 to be polished is subjected to polishing.

The apparatus has a dresser 17 which performs dressing during polishing. The dresser 17, for example, comprises-diamond abrasive particles bonded to a flat plate. Like the top ring 13, the dresser 17 exerts a pressure on the polishing surface of the abrading plate while rotating, thereby dressing the polishing surface of the abrading plate. A dresser holder 16 presses down the dresser 17 while holding the dresser 17 and rotating to allow the dresser 17 to rotate and be pressed downwardly like the top ring 13.

This apparatus has liquid supply nozzles 15A, 15B, 15C. The nozzle 15A supplies pure water onto the polishing surface of the abrading plate 12, and is generally indispensable to polishing using the abrading plate. Pure water supplied to the polishing surface of the abrading plate and the polished surface of the semiconductor wafer plays the role of lubricating and cooling these surfaces. The nozzle 15B supplies a surface active agent. By supplying the surface active agent to the polishing surface of the abrading plate and the polished surface of the semiconductor wafer, the object to be polished, the nozzle 15B permits emergence of the self-stop function that when the polishing of the substrate proceeds to flatten it, polishing automatically proceeds no more. An example of the surface active agent is a substance having both a hydrophilic atomic group and a hydrophobic atomic group in the molecule. AS the surface active agent, for example, special carboxylic acid type high molecular surface active agents, and metal free type surface active agents having their sodium salts substituted by ammonium salts are usable. The nozzle 15C supplies other chemical solutions such as buffers. A buffer, when supplied to the wafer and the polishing surface of the abrading plate, can increase the polishing speed of the device wafer. Examples of the buffer are aqueous ammonia ($NH_4OH$), acetic acid ($CH_3COOH$), and potassium carbonate ($K_2CO_3$). In this apparatus, pure water, a surface active agent, and/or other chemical solutions can be supplied arbitrarily, singly or in combination, from these nozzles 15A, 15B and 15C to the polishing surface of the abrading plate and the polished surface of the semiconductor wafer by a controller (not shown).

When a surface active agent is supplied to these surfaces during polishing using the abrading plate, a film of the surface active agent is formed between the polished surface of the wafer and the polishing surface of the abrading plate. The film formed on a convex surface of the polished surface of the wafer is thinner than the diameter of the abrasive particles used, and the abrasive particles are easily pressed down by the wafer, so that a certain level of polishing speed is obtained. That is, at the initial stage and intermediate stage of polishing at which the projections of the polished surface of the wafer have some height, the polishing speed is not particularly lowered, even in the presence of the surface active agent. However, after polishing proceeds, the film formed on the concave surface of the projections and depressions of the polished surface of the wafer becomes thicker than the diameter of the abrasive particles used, and the abrasive particles are minimally pressed down by the wafer, so that the polishing speed is reduced. These actions are utilized to polish away the projections preferentially, with the depressions being minimally polished away. This outcome leads to the appearance of the self-stop function that the polishing speed extremely lowers when the projections are flattened, as stated earlier.

When the polishing surface of the abrading plate is dressed with the use of a dresser, on the other hand, it is known that a large amount of free(self-generated) abrasive particles is produced, and the polishing speed can be stabilized. Thus, like the apparatus shown in FIGS. 1A and 1B, there can be performed In Situ dressing in which while the wafer is being polished with the abrading plate on a part of the rotating turn table, the polishing surface of the abrading plate is dressed by use of the dresser. As a result, a constant amount of free abrasive particles always exists during polishing, thus stabilizing the polishing speed. With this method, however, the abrasive particles always self-generate, and polishing proceeds even after elimination of steps. Accordingly, the self-stop function does not emerge.

Figure 2:
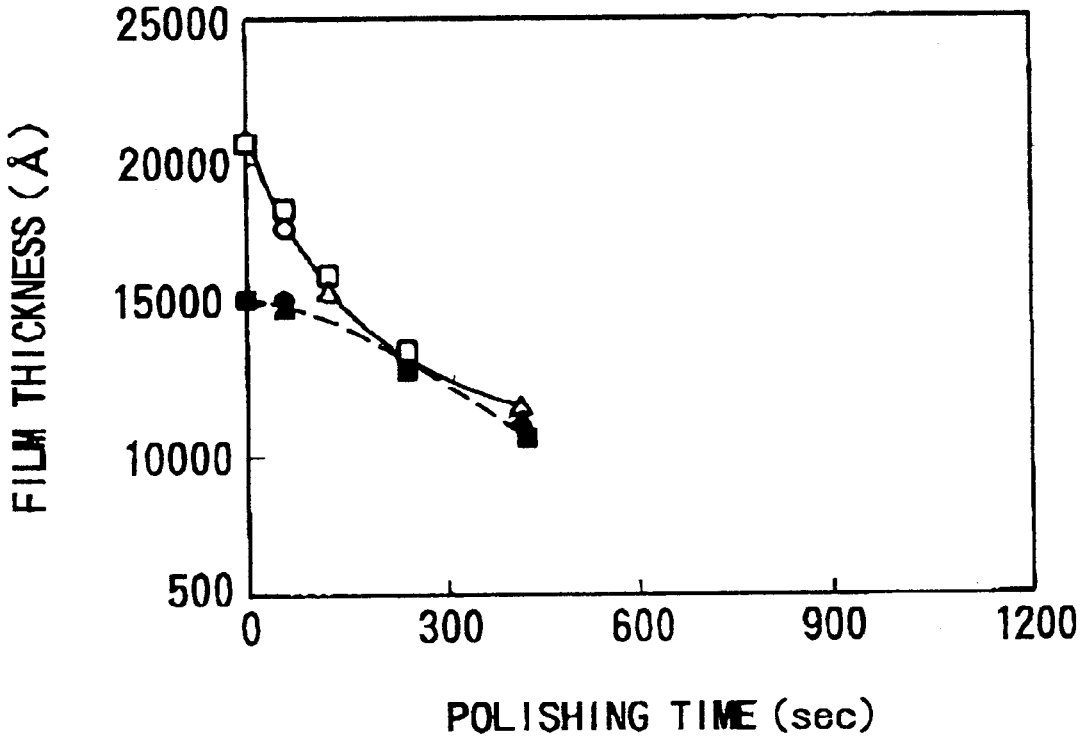
FIG. 2 is a view showing changes in the film thickness upon supply of only pure water to a polishing surface during polishing accompanied by dressing.

Next, the effects of the surface active agent will be described with reference to FIGS. 2 and 3A to 3C. FIG. 2 shows the results when only pure water is supplied during polishing of a device wafer accompanied by dressing in the apparatus shown in FIGS. 1A and 1B. In the drawing, open marks represent projections, and solid marks represent depressions, with the mark ○ denoting 500 $\mu$m, the mark Δ 2,000 $\mu$m, and the mark □ 4,000 $\mu$m. This drawing shows that the projections are polished away rapidly over time, and the depressions are also polished slowly, and that polishing proceeds even after elimination of steps. That is, the illustrated polishing data demonstrate that no self-stop function appears in polishing accompanied by dressing and involving the supply of only pure water.

Figure 3A:
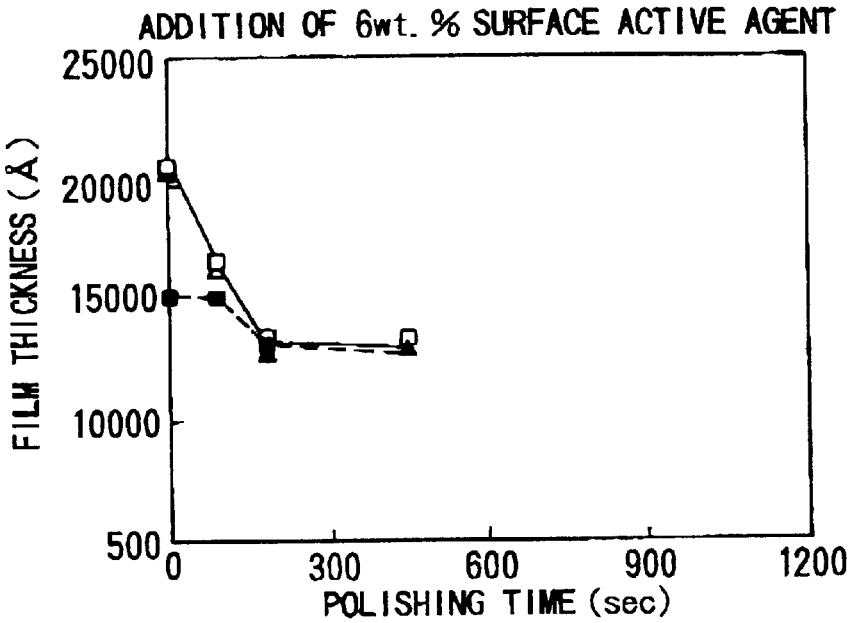
Figure 3B:
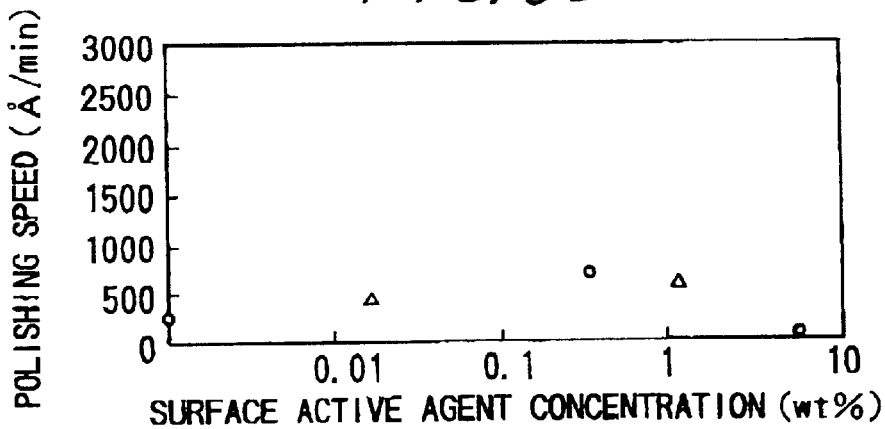
Figure 3C:
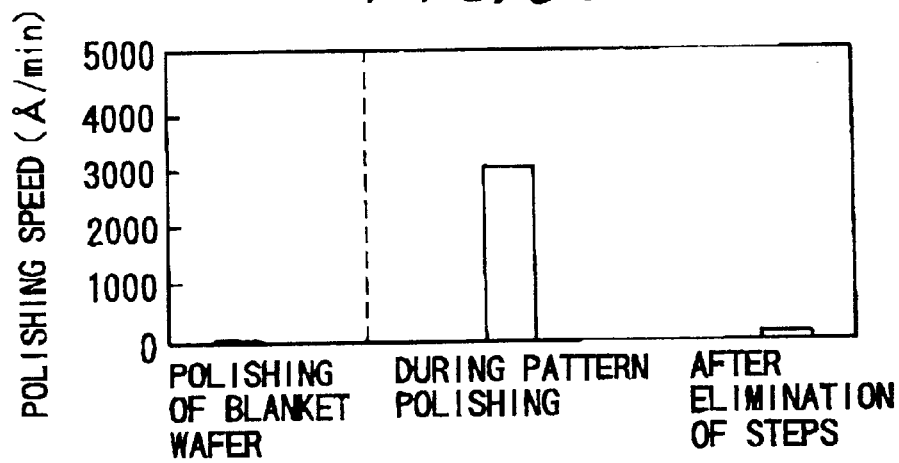

FIGS. 3A to 3C show the results of polishing accompanied by dressing and the supply of pure water containing a constant amount of a surface active agent. FIG. 3A presents the results of polishing using pure water containing 6 wt.% of the surface active agent, with dressing being performed at a low surface pressure of, for example, 50 g/cm$^2$. As illustrated, the projections (open marks) are rapidly polished, the depressions (solid marks) are slowly polished, the film thicknesses of the projections and the depressions coincide at about 300 seconds, and thereafter polishing no longer proceeds. FIG. 3B is a view showing the dependency of the polishing speed for a blanket wafer on the concentration of the surface active agent. The concentration of the surface active agent is taken on the horizontal axis, and the polishing speed is taken on the vertical axis. At a surface active agent concentration of 6%, the polishing speed for the blanket wafer is shown to be almost zero. Polishing the device wafer under these conditions, therefore, shows a tendency that polishing nearly stops after elimination of steps. That is, the self-stop function is considered to emerge. As shown in FIG. 3C, the polishing speed in the presence of the projections and depressions of the device wafer is about 3,000 Å, while the polishing speed for the blanket wafer is precisely as low as about 40 Å. Thus, when steps are eliminated to achieve flattening, a blanket wafer or smooth film state is produced, and the polishing speed lowers extremely. Accordingly, the self-stop function is assumed to have appeared.

If the surface pressure during dressing is as high as 400 g/cm$^2$, for example, free abrasive particles may be oversupplied depending on the composition conditions of the abrading plate. The self-stop function by the surface active agent may fail to be exhibited, and polishing may further proceed even after flattening. In this case, it is preferred to lower the surface pressure during dressing, in order to adjust the amount of free abrasive particles.

According to the composition conditions for an abrading plate (proportions of abrasive particles, binder, and pores), the abrading plate is classified broadly into three types:

First group: Abrading plate with a high polishing speed (it can polish a device wafer without dressing before and during polishing).

Second group: Abrading plate with an intermediate polishing speed (it can polish a device wafer if dressing is performed before polishing). This type of abrading plate generally shows the self-stop function.

Third group: Abrading plate with a low polishing speed (it can polish a device wafer if dressing is performed during polishing).

Of the foregoing types of abrading plates, the abrading plate of the third group requires polishing accompanied by the aforementioned dressing in order to increase and stabilize the polishing speed. To show the self-stop function, supply of a surface active agent is preferred, but termination of dressing can also bring about this function. The abrading plate of the first group provides a certain level of polishing speed, thus requiring no dressing before and during polishing. To show the self-stop function, supply of a surface active agent is indispensable. To stabilize the polishing speed, however, dressing during polishing may be performed. Regarding the abrading plate of the second group, if dressing is performed before polishing, the device wafer can be polished at a certain level of polishing speed, and the self-stop function, also appears. Thus, neither polishing accompanied by dressing, nor the use of a surface active agent is necessary. To stabilize the polishing speed, it is permissible to carry out dressing during polishing. To show the self-stop function clearly, a surface active agent may be supplied.

Next, a savings in the consumption of a surface active agent will be discussed. As described earlier, the use of a surface active agent in polishing of a device wafer with an abrading plate is intended to show the self-stop function after elimination of steps. Until elimination of steps, an abrading plate has excellent step characteristics, and a surface active agent is basically unnecessary. Hence, no surface active agent needs to be supplied for some time after the start of polishing. Theoretically, it would be sufficient to start the supply of a surface active agent immediately before elimination of steps. If it is possible to measure the film thickness of the projections of the device wafer during polishing by means of a monitor or the like, it is advisable to detect the film thickness immediately before elimination of steps and start the supply of a surface active agent. Actually, however, it is not necessarily easy to monitor the polished surface and confirm the status of polishing of fine irregularities. Provision of such a monitor would require surplus cost and space, so that it is not preferred to dispose such a monitor. Polishing accompanied by dressing is expected to make a time controlled savings in the consumption of a surface active agent sufficiently feasible, because the polishing speed of the device wafer is practically stable. In detail, a time required until steps are eliminated to bring flattening is considered to be nearly constant. Let the required time until flattening be T seconds. Then, the supply of a surface active agent is started after a lapse of time corresponding to 2T/3 to 4T/5 seconds from the start of polishing. By so doing, the consumption of the surface active agent can be markedly decreased, for example, to a half or less, in comparison with the start of supply at the beginning of polishing.

Figure 4:
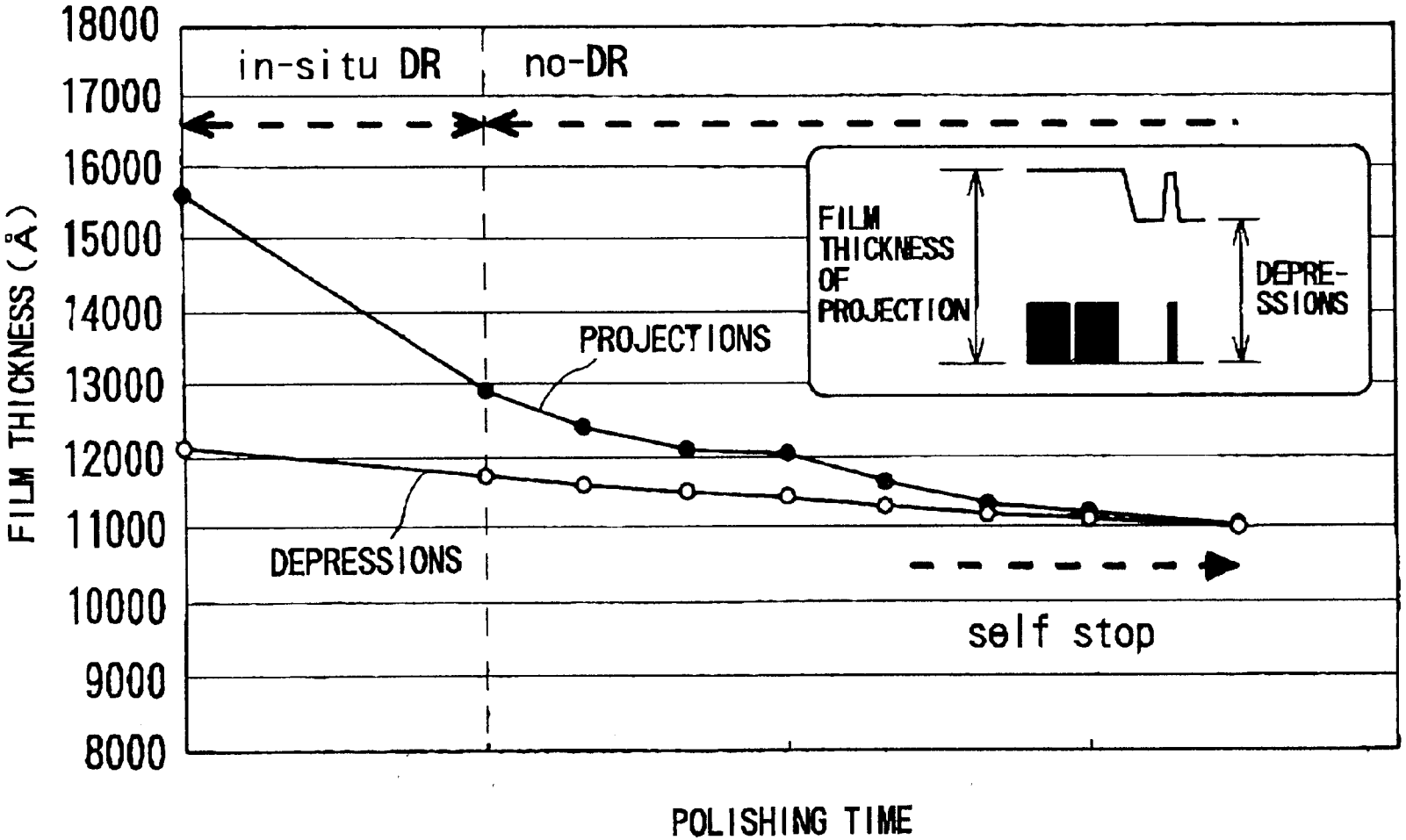
FIG. 4 is a view showing the relationship between the polishing time and the film thickness when dressing was stopped and only polishing was allowed to proceed, during polishing accompanied by dressing.

The use of a surface active agent brings an increase in the polishing cost per wafer. If possible, it is preferred to emerge the self-stop function without using a surface active agent. A method for achieving this may be to stop dressing and proceed only with polishing in the process of polishing accompanied by dressing. AS stated previously, abrading plates can be broadly classified into 3 types, namely, first, second, and third groups based on the polishing characteristics. Of these abrading plates, the abrading plate of the third group can scarcely polish the device wafer, unless polishing is performed together with dressing. In other words, polishing accompanied by dressing enables this type of abrading plate to polish the device wafer, because necessary free abrasive particles are self-generated thereby. When dressing is stopped, polishing proceeds for some time, as long as the remaining abrasive particles exist. After the remaining abrasive particles flow from the polishing surface, polishing does not proceed any more, and the progress of polishing stops substantially. This effect corresponds to the self-stop function. FIG. 4 shows the results of procedure in which during polishing accompanied by dressing (i.e., In Situ dressing), dressing was stopped, and only polishing was allowed to proceed (i.e., No dressing), and device wafer polishing was actually carried out. That is, the wafer was polished, with dressing being performed (i.e., In Situ dressing), for a predetermined time after the start of polishing, whereafter the wafer was polished without dressing (i.e., No dressing). From FIG. 4, one will see that for the projections of the device wafer, the polishing speed is fast with the In Situ dressing, but in the No dressing, the polishing speed gradually lowers, showing the self-stop function. In detail, during the In Situ dressing, free abrasive particles are self-generated, so that many free abrasive particles are present, and the polishing speed is high. As the remaining abrasive particles drain from the polishing surface after stoppage of dressing, the polishing speed gradually slows, and the self-stop function appears. In the embodiment shown in FIG. 4, the dressing surface pressure during the In Situ dressing was set at about 50 g/cm$^2$. To exhibit the self-stop function clearly, however, the surface pressure for dressing during polishing may be increased to raise the polishing speed of the device wafer. It is also permissible to carry out polishing while supplying a surface active agent during the step of the No dressing polishing.

After completing polishing of the wafer with an abrading plate (abrading plate polishing), the wafer is washed with pure water, and touch-up(finish-polishing) by ordinary chemical and mechanical polishing (CMP) is performed. This is intended to remove the polishing abrasive particles adhering to the surface of the wafer and remove flaws (scratches) on the wafer surface. Ordinary CMP as used here refers to a method which performs polishing with a polishing cloth (a resinous pad free of abrasive particles) pressed against the wafer while supplying a slurry (a solution containing a lot of abrasive particles). AS the slurry, fumed silica slurry, colloidal silica slurry, ceria slurry, or alumina slurry, for example, is used. The average particle size of the abrasive particles of the slurry is 200 nm or less, preferably 100 nm or less. Preferably, the slurry has a sharp particle size distribution, is free of large abrasive particles, and is at least free from abrasive particles having a particle size of 500 nm or more. Examples of the polishing cloth are commercially available elastic pads such as an IC1000 pad (a polyurethane-based closed cell foam, produced by Rodel) and a SUBA400 pad (a non-woven fabric type, a product of Rodel). In the embodiment shown in FIG. 4, the device wafer after abrading plate polishing was additionally polished in an amount calculated as a film thickness of about 500 Å by ordinary CMP. This touch-up can remove the deposited particles and scratches on the wafer surface almost completely.

Figure 5:
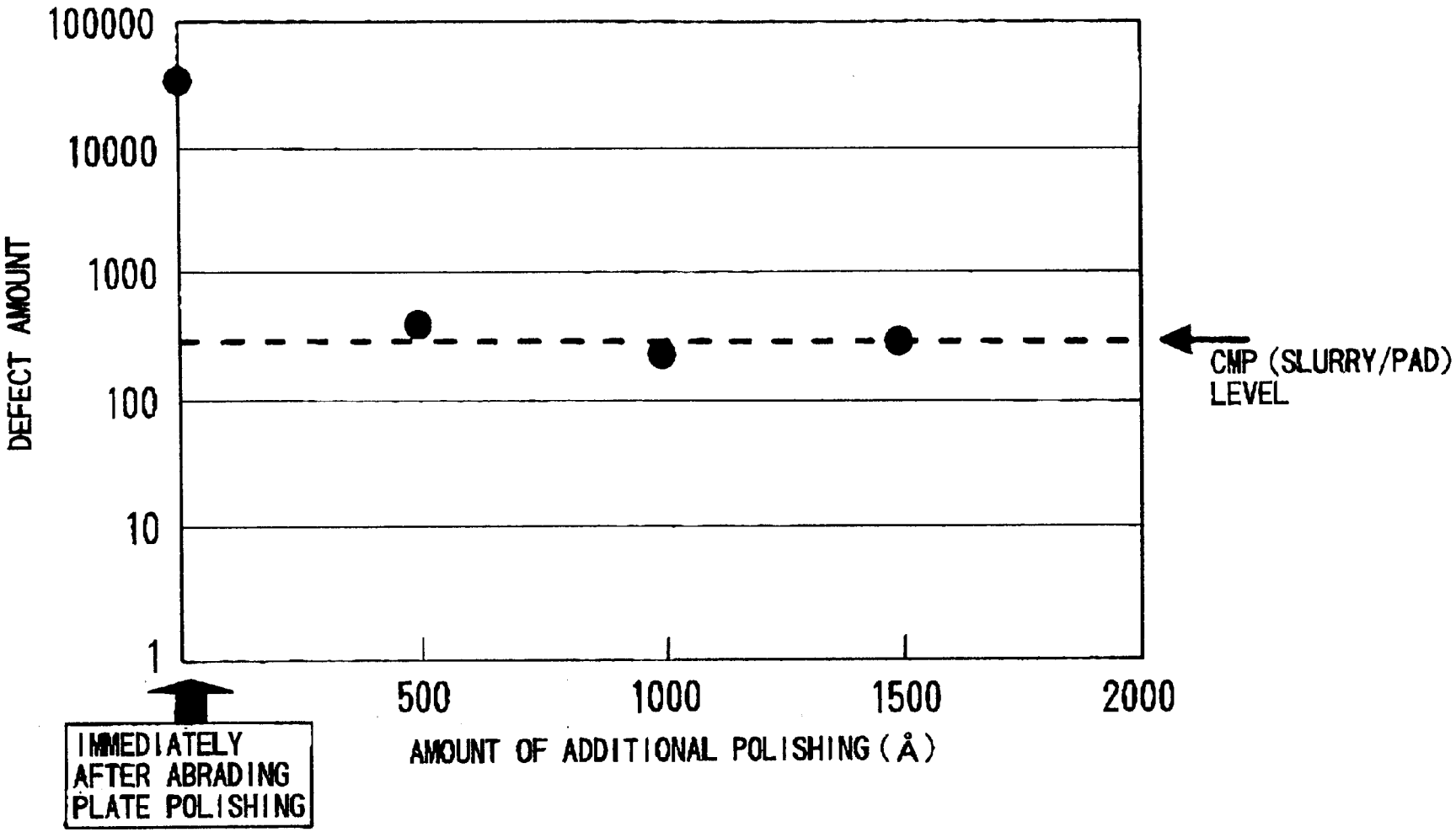
FIG. 5 is a view showing the relationship between the amount of additional polishing and the amount of defect when touch-up was performed after polishing with an abrading plate.

As an example of the touch-up, FIG. 5 shows changes in the amounts of deposits and flaws on the surface of a blanket wafer which was polished with an abrading plate and then subjected to touch-up. The defect amount represents the total amount of deposits and flaws on the surface of the wafer. FIG. 5 reveals that immediately after abrading plate polishing, the defect amount was large, but when touch-up was performed to a degree corresponding to 500 Å calculated as film thickness, the defect amount could be reduced to the ordinary CMP level. Of course, depending on the amount of deposits and flaws, the polishing amount of the touch-up may be less than 500 Å. The present embodiment illustrated touch-up in the No dressing polishing after the In Situ dressing polishing. Such touch-up, needless to say, is not restricted to cases of No dressing polishing after In Situ dressing polishing, but may be widely applied to cases after abrading plate polishing.

Figure 6:
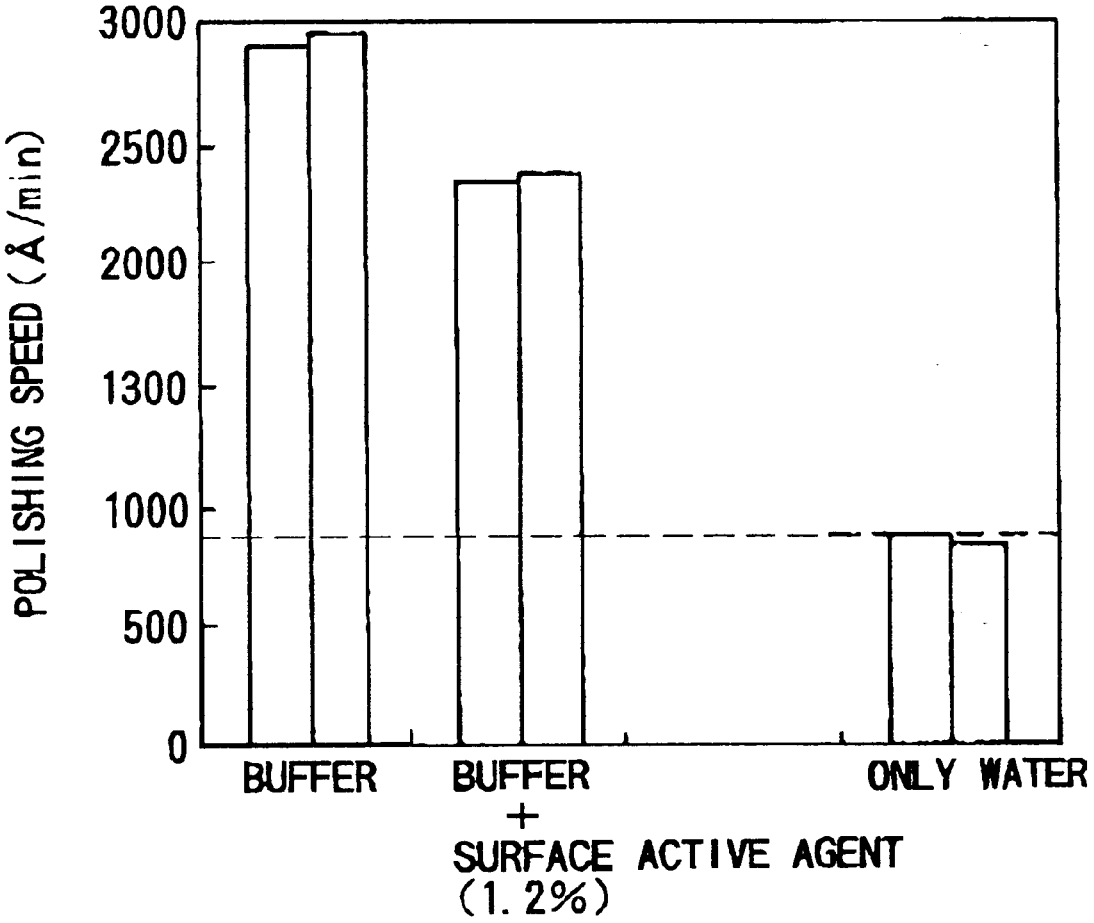
FIG. 6 is a view comparing the polishing speeds upon addition of a buffer and in the presence of water alone.

Next, the addition of a buffer will be discussed. As stated earlier, the polishing speed of a blanket wafer (smooth film) needs to be much lower than the polishing speed of a device wafer, in order to show the self-stop function. In other words, the self-stop function can be exhibited clearly by increasing the polishing speed of a device wafer relative to the polishing speed of a blanket wafer. In the polishing of a silicon oxide film which is an interlayer insulator film, for example, the addition of a constant amount of a buffer to pure water is known to increase the polishing speed of the blanket wafer markedly. As shown in FIG. 6, the addition of a buffer increases the polishing speed to about 3 times that of polishing only with water. Further addition of a surface active agent in combination with a buffer increases the polishing speed to more than about 2 times that of polishing only with water, although the increase is smaller than upon addition of the buffer. The amount of this surface active agent is 1.2 wt.% . In view of these results, the addition of the buffer during polishing of a device wafer increases the polishing speed of the projections of the device wafer markedly. Then, steps are eliminated to flatten the device wafer. Since the polishing speed at this time is greatly different from the polishing speed for the projections, the self-stop function can be exhibited. The buffer is effective for promoting the polishing of a silicon oxide film, but an oxidizing agent or an etchant is effective for polishing a metal film, for example.

Figure 7A:
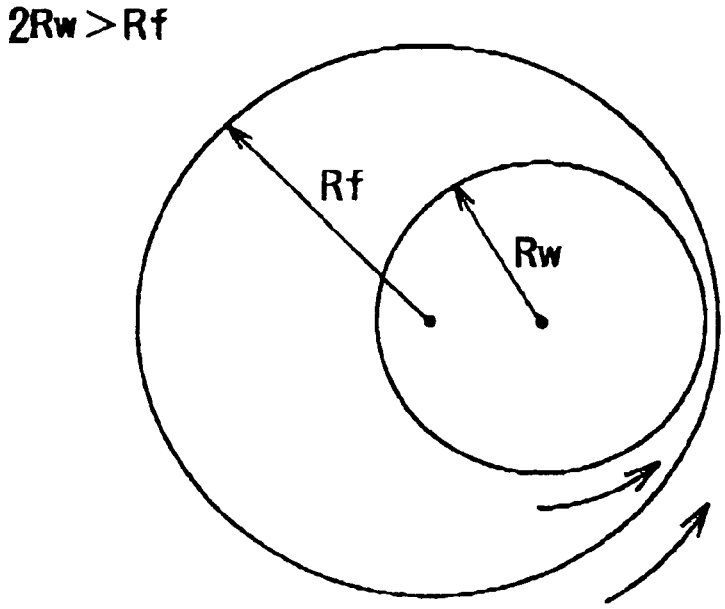
FIGS. 7A and 7B are views showing examples of a polishing apparatus preferred for a polishing method which exhibits the self-stop function.
Figure 7B:
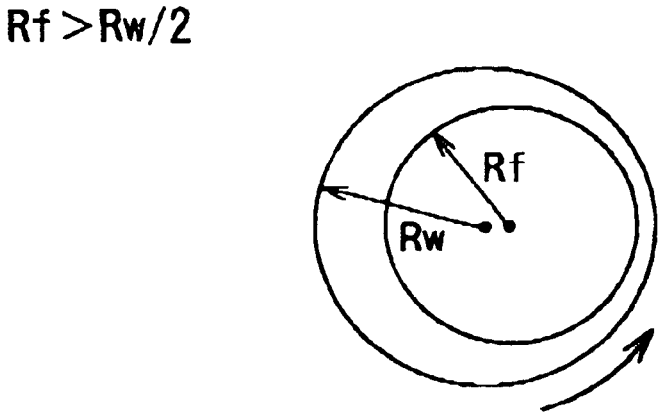

FIGS. 7A and 7B show an apparatus preferred for a polishing method using an abrading plate which shows the aforementioned self-stop function. In this apparatus, the size of an abrading plate fixed to a turntable is markedly decreased compared with the apparatus shown in FIG. 1. Let the radius of a wafer, an object to be polished, be Rw, and the radius of an abrading plate fixed to a turn table be Rf. These sizes are in the following relationship:

$$2Rw > Rf > Rw/2$$

With chemical and mechanical polishing (CMP), which polishes a device wafer by supplying a conventional polishing solution (slurry) to a polishing cloth, it is generally said that uniformization of the relative speed within the wafer surface is a prerequisite. Based on this concept, the size of the turntable has been set so that the radius of the abrading plate on the turntable will be greater than the diameter of a wafer to be polished. In polishing a device wafer while making use of the self-stop function, however, when the projections are removed by polishing to eliminate the steps, polishing does not proceed any longer. In other words, even if variations exist in the polishing speed within the wafer surface, polishing does not proceed after elimination of the steps. This means that the resulting polish surface has nothing to do with variations in the polishing speed within the wafer surface. If such a polishing method utilizing the self-stop function is possible, therefore, variations in the polishing speed within the wafer surface are permissible. Hence, the diameter of the wafer (2 Rw) may be larger than the radius of the abrading plate (Rf) as shown in FIG. 7A, or the diameter of the abrading plate (2 Rf) may be larger than the radius of the wafer (Rw) as shown in FIG. 7B. The condition (b), Rf>Rw/2, has been set, because if the radius of the wafer (Rw) is greater than the diameter of the abrading plate (2 Rf), the center r.f gravity of the wafer will deviate from the abrading plate surface and stability will be impaired. Because of these contrivances, the size of the turntable can be made much smaller than the conventional size, and the size of the abrading plate can also be made much smaller than the conventional size. Consequently, the degree of freedom of design of the apparatus can be markedly increased to contribute remarkably to downsizing of the apparatus.

Figure 8A:
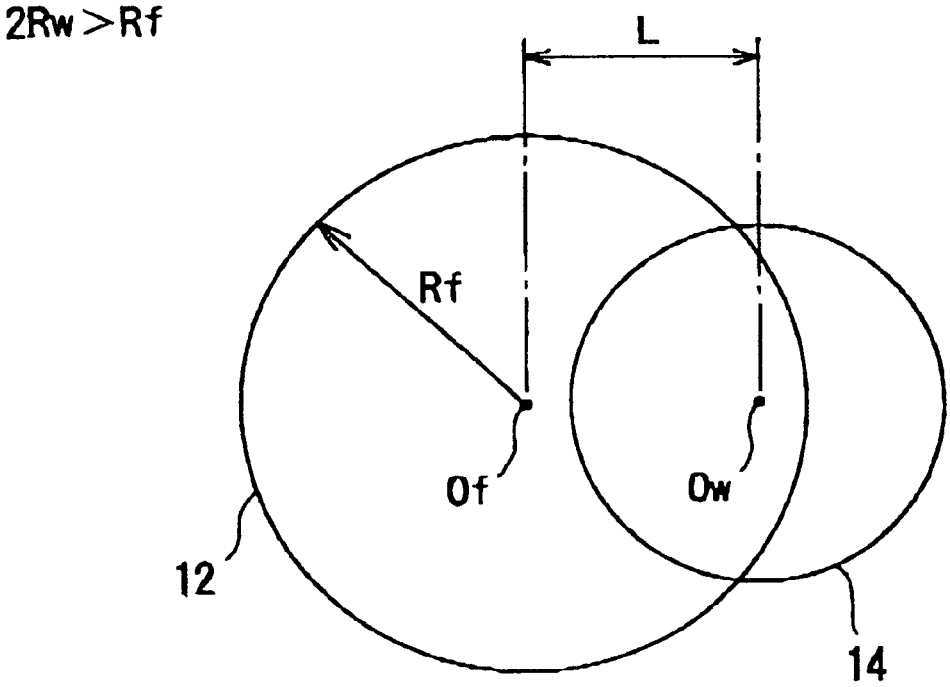
FIGS. 8A and 8B are views showing the positional relationship between the wafer and abrading plate in the apparatus illustrated in FIGS. 7A and 7B.
Figure 8B:
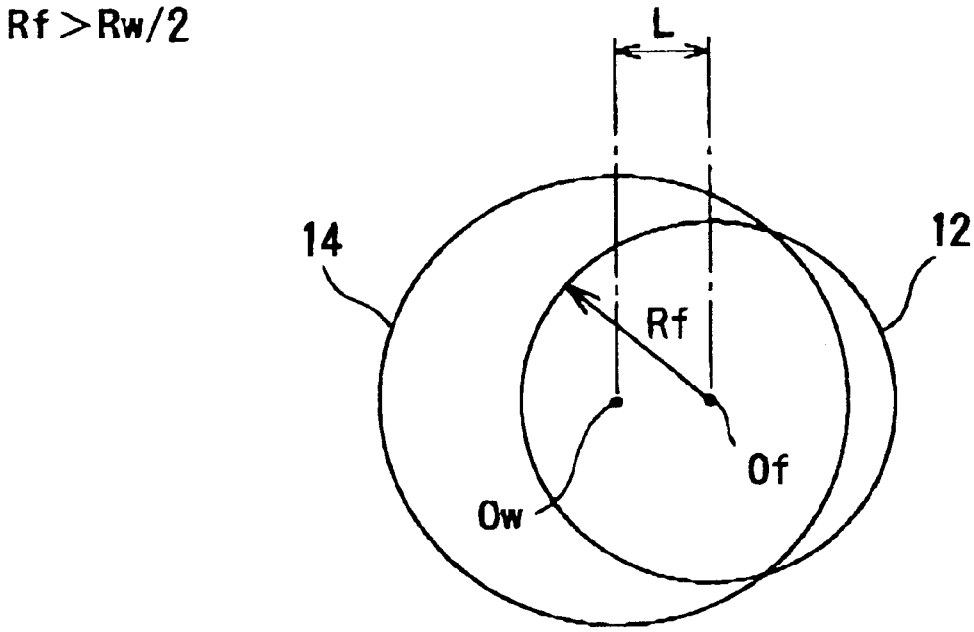

FIGS. 8A and 8B are views showing the positional relationship between the center of the wafer, Ow, and the center of the abrading plate, of, in the apparatus shown in FIGS. 7A and 7B. FIG. 8A shows a case in which the diameter of the wafer (2Rw) is greater than the radius of the abrading plate (Rf), while FIG. 8B shows a case in which the diameter of the abrading plate (2Rf) is greater than the radius of the wafer (Rw). If the polished surface of the wafer leaves the polishing surface of the abrading plate, the radius of the abrading plate (Rf) is made greater than the distance (L) between the center of the wafer, Ow, and the center of the abrading plate, of, as shown in FIGS. 8A and 8B. In this state, polishing is performed, with the relative positional relationship between the wafer and the abrading plate being fixed, or with their relative positional relationship being changed, for example, by pivoting or scanning. By so making the radius of the abrading plate (Rf) greater than the distance (L) between the center of the wafer, Ow, and the center of the abrading plate, of, the center (center of gravity) of the wafer, Ow, is always positioned on the abrading plate. Thus, the situation that the center of gravity of the wafer deviates from the abrading plate surface to incline the top ring can be prevented reliably, and stability can be enhanced.

Figure 9:
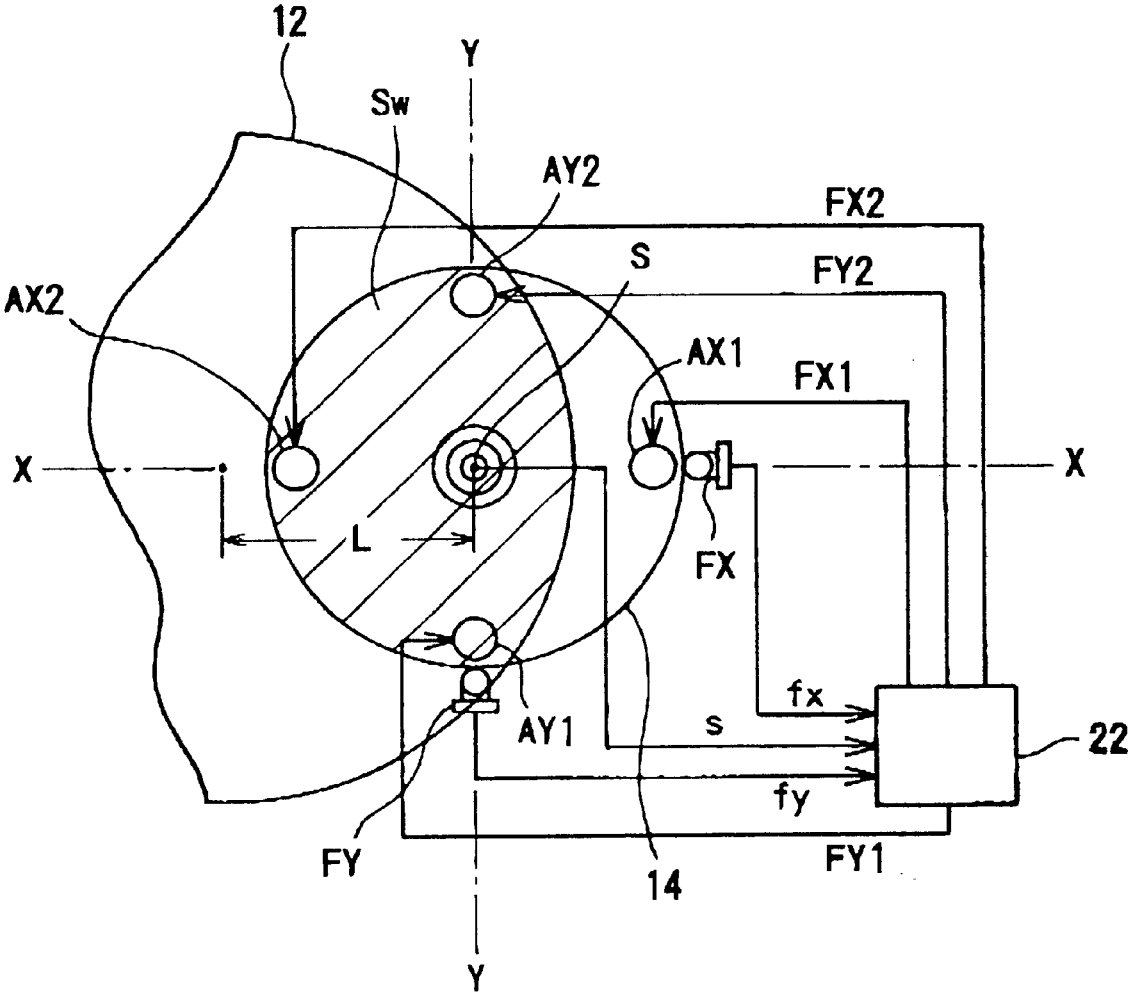
FIG. 9 is a view showing the schematic constitution of the polishing apparatus according to the embodiment of the present invention.

During polishing, a frictional force develops at the site of contact between the wafer and the abrading plate, and may cause a turning moment to the top ring 13 holding the wafer 14, thereby inclining the top ring. Particularly when the polished surface of the wafer leaves the polishing surface of the abrading plate, as stated above, the site of contact with the abrading plate is only a part of the wafer. Since a frictional force occurs in this part alone, a tendency toward inclination of the top ring may become stronger. Hence, the polishing apparatus according to the present embodiment aims at canceling out the turning moment, which is due to the frictional force occurring in the polished surface of the wafer, while considering the area of contact between the wafer and the abrading plate. For this purpose, the polishing apparatus has actuators AX1, AX2, AY1 and AY2 each including a cylinder 20 and a piston 21, a frictional force sensor FX, a frictional force sensor FY, a position sensor S, and an operational controller 22, as shown in FIGS. 9 and 10.

Figure 10:
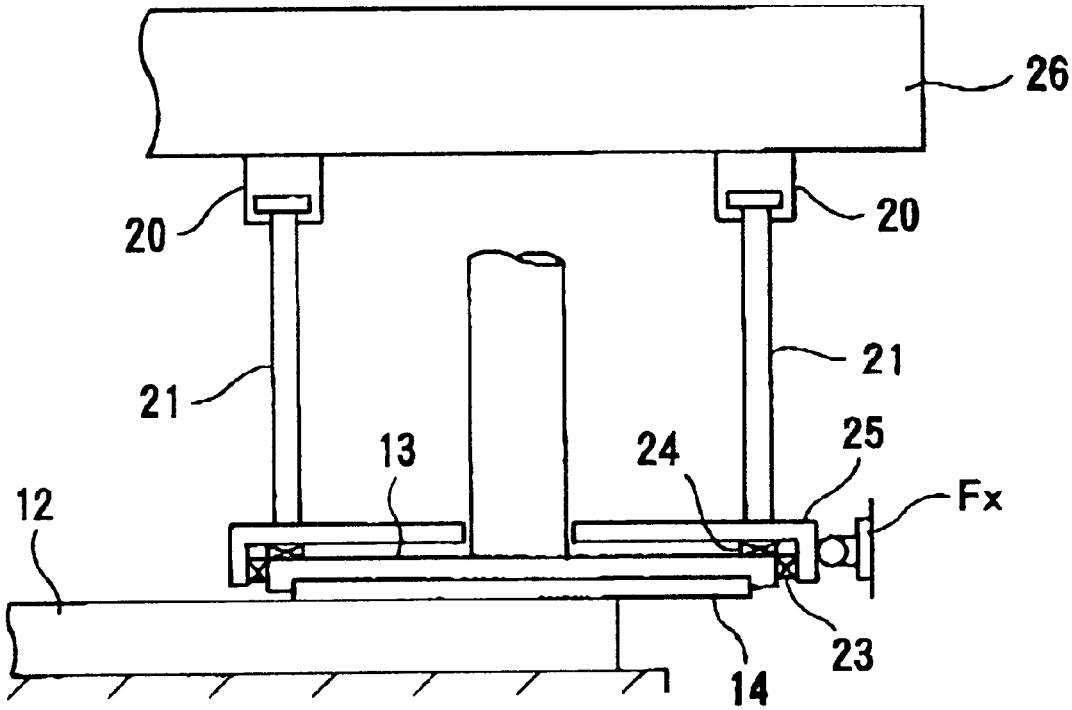
FIG. 10 is a sectional view taken on line x—x of FIG. 9.

AS shown in FIG. 10, a presser plate 25 is provided above a top ring 13 via bearings 23, 24. The actuators AX1, AX2, AY1, AY2 are disposed between four points in an X direction and a Y direction of an upper surface on an outer periphery of the presser plate 25 and a top ring arm 26. As a result, the presser plate 25 is pressed downwardly by the action of the actuators AX1, AX2, AY1, AY2. As shown in FIG. 9, the frictional force sensor FX and the frictional force sensor FY are disposed in a side surface on an outer periphery in the X direction and Y direction of the presser plate 25 to detect a frictional force between the wafer 14 and the abrading plate 12 which is exerted on the wafer 14. The frictional force sensor FX and the frictional force sensor FY detect an X direction component fx and a Y direction component fy, respectively, of the above frictional force. The outputs fx and fy from the frictional force sensor FX and the frictional force sensor FY are entered into the operational controller 22. The position sensor S is provided on a shaft of the top ring 13 to detect the distance L between the center of the wafer 14 and the center of the abrading plate 12. An output s of this position sensor S is also entered into the operational controller 22.

Figure 11:
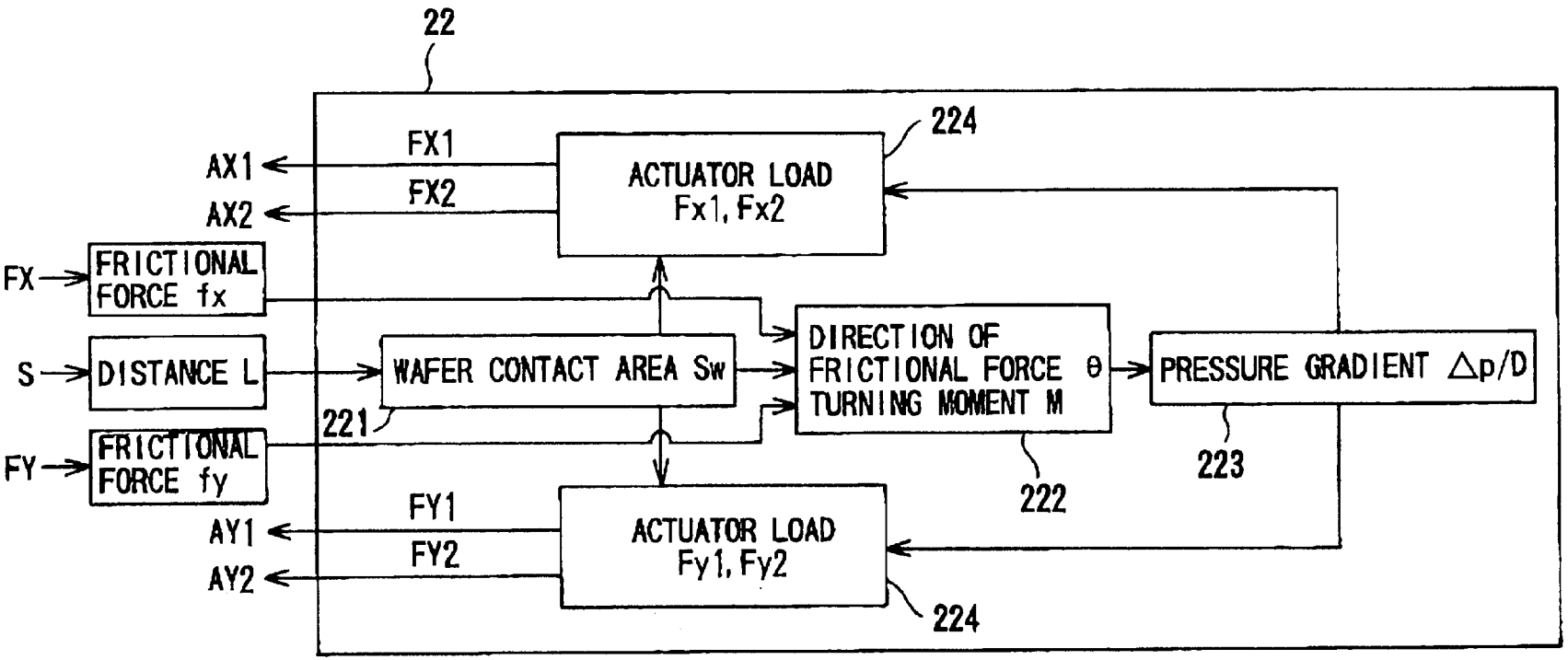
FIG. 11 is a functional block diagram of an operational controller of FIG. 9.

FIG. 11 is a functional block diagram of the operational controller 22. As illustrated, an arithmetic unit 221 of the operational controller 22 calculates an area of contact Sw, between the wafer and the abrading plate on the basis of the output s from the position sensor S. On the other hand, an arithmetic unit 222 of the operational controller 22 calculates a direction θ of a frictional force and a turning moment M on the basis of the output (frictional force) fx and the output (frictional force) fy of the frictional force sensor FX and the frictional force sensor FY, respectively, and further corrects the direction 0 of frictional force and the turning moment M on the basis of the output s from the position sensor S and the area of contact Sw. Then, an arithmetic unit 223 calculates a pressure gradient (Δp/D where Δp denotes a pressure difference, and D denotes the diameter of the wafer) on the basis of the direction θ of frictional force and the turning moment M. Further, an arithmetic unit 224 calculates loads FX1, FX2, FY1, FY2 imposed by the actuators AX1, AX2, AY1, AY2 on the presser plate 17 on the basis of the pressure gradient, and further corrects the loads FX1, FX2, FY1, FY2 on the basis of the output s from the position sensor S. The corrected loads FX1, FX2, FY1, FY2 are outputted to the actuators AX1, AX2, AY1, AY2. Such loads FX1, FX2, FY1, FY2,for canceling out the turning moment M due to the frictional force f, are given to the piston 21 via the cylinder 20 by the actuators AX1, AX2, AY1, AY2. Consequently, the turning moment M due to the frictional force f that occurs in the polished surface of the wafer 14 can be canceled out in consideration of the contact area Sw between the wafer and the abrading plate. Thus, the inclination of the top ring 13 can be prevented, and a tumble of the wafer in the deviating direction can be prevented effectively.

Figure 12:
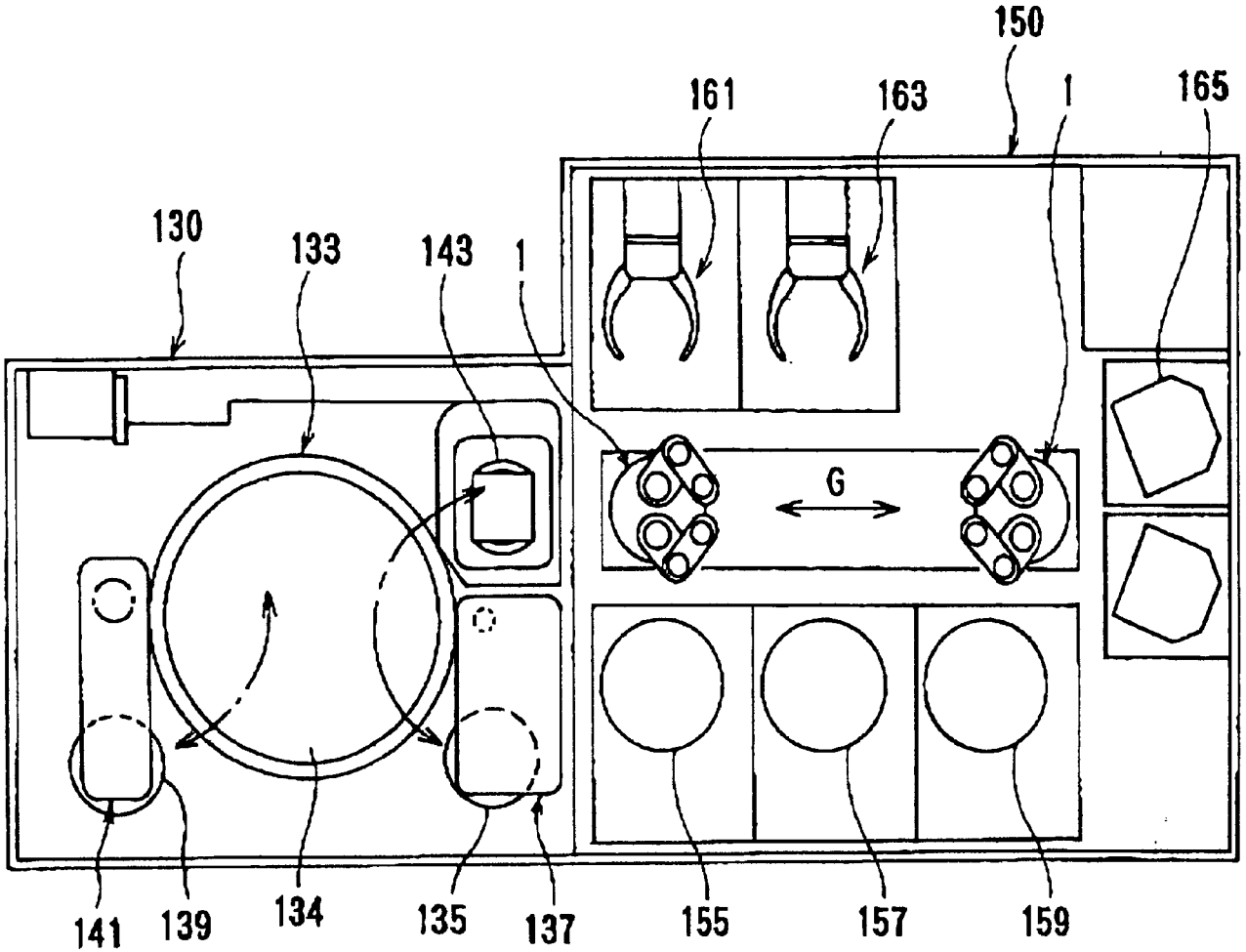
FIG. 12 is a view illustrating an entire structure of a polishing system according to a first embodiment.

Next, the layout of a first embodiment of the polishing apparatus according to the present invention will be described. The structure of the entire polishing apparatus according to the first embodiment is shown, for example, in FIG. 12. FIG. 12 is a schematic, sectional plan view showing the entire constitution of the interior of the polishing apparatus. As shown in the drawing, the polishing apparatus is composed of a polishing section 130 and a cleaning section 150. The polishing section 130 has a turn table 133 disposed at the center thereof. On both sides of the turn table 133, there are disposed a polishing unit 137 equipped with a top ring 135, and a dressing unit 141 equipped with a dressing tool 139. Laterally of the polishing unit 137, a work receiving/delivering device 143 is installed. On an upper surface of the turn table 133, an abrading plate formed from abrasive particles and a binder is mounted. An upper surface of the abrading plate constitutes a polishing surface 134.

The cleaning section 150 is composed in the following manner: Two carrier robots 1 and 1 movable in a direction of an arrow G are installed at the center of the cleaning section 150. On one side of these robots, a primary cleaner 155, a secondary cleaner 157, and a spin dryer (or a dryer having a cleaning function) 159 are disposed side by side. On the other side of the robots, two work inverters 161 and 163 are disposed side by side. When a cassette 165 accommodating semiconductor wafers before polishing is set in a position shown in FIG. 12, the right-hand carrier robot 1 takes the semiconductor wafers one by one out of the cassette 165, and passes them on to the work inverter 163, which inverts the semiconductor wafer. The semiconductor wafer is further passed from the inverter 163 on to the left-hand carrier robot 1, and is then carried to the work receiving/delivering device 143 in the polishing section 130.

The semiconductor wafer on the work receiving-delivering device 143 is held by a lower surface of the top ring 135 of the polishing unit 137 pivoting as shown by one-dot chain arrows, and is moved onto the turn table 133. The semiconductor wafer is polished on the polishing surface 134 of the rotating turn table 133. The semiconductor wafer after polishing being finished is returned to the work receiving/delivering device 143, and delivered to the work inverter 161 by the left-hand carrier robot 1 in the drawing. While being cleaned with pure water, the semiconductor wafer is inverted, whereafter it is cleaned with a cleaning solution or pure water by the primary cleaner 155 and secondary cleaner 157. Then, the semiconductor wafer is spin dried with the spin dryer (or a dryer with a cleaning function) 159. Then, the so treated semiconductor wafer is returned to the cassette 165 by the right-hand carrier robot 1 in the drawing. After completion of polishing of the semiconductor wafer with the use of the top ring 135, the dressing unit 141 moves onto the turn table 133 as shown by one-dot chain arrows, and presses the rotating dressing tool 139 against the polishing surface 134 of the rotating turn table 133 to dress (regenerate) the polishing surface 134 of the abrading plate.

Figure 13:
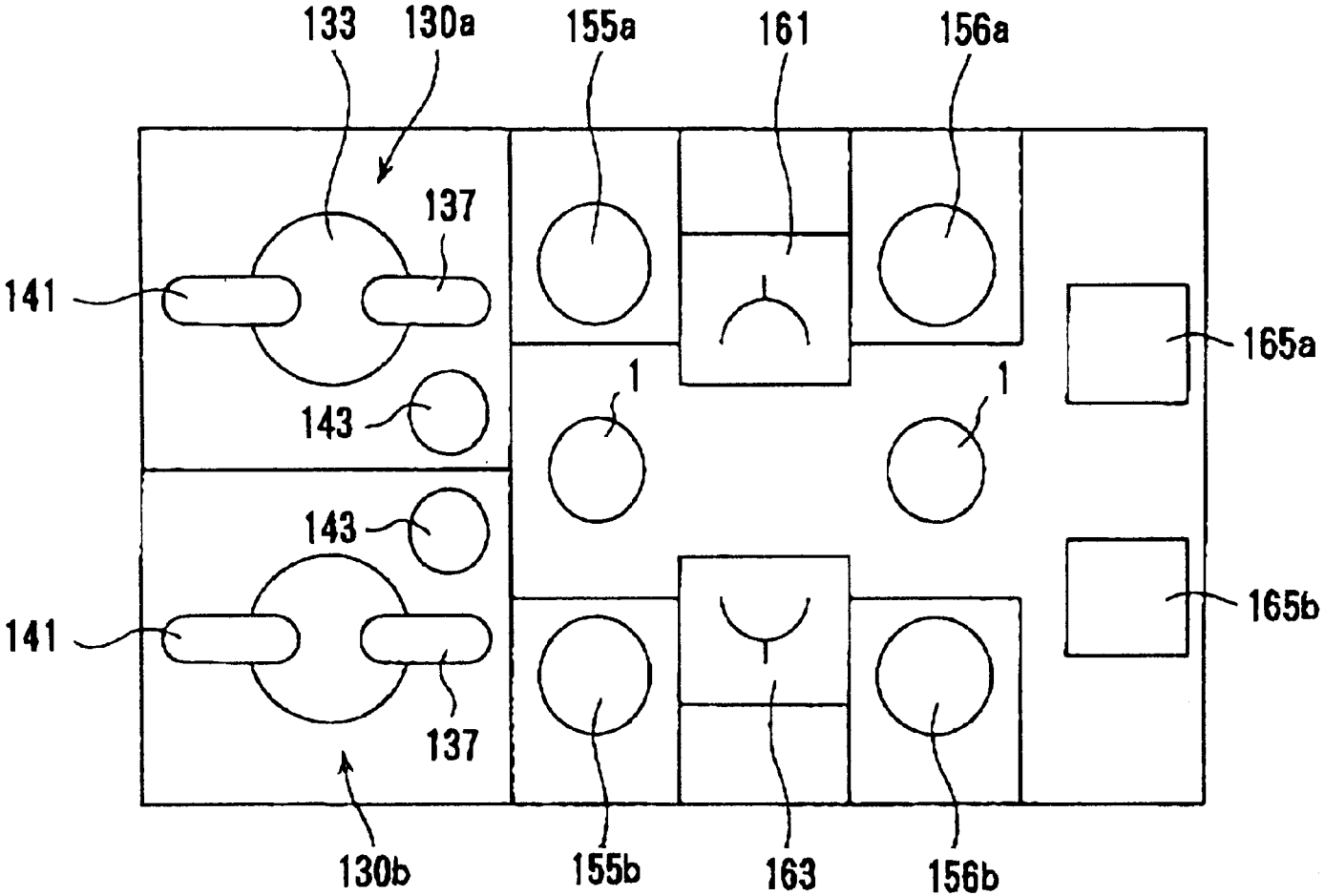
FIG. 13 is a plan view schematically showing a polishing system according to a second embodiment.

Next, the layout of a second embodiment of the polishing apparatus according to the present invention will be described. The structure of the entire polishing apparatus according to the second embodiment is shown, for example, in FIG. 13. The present embodiment illustrates, but is not restricted to, an example in which touch-up of a wafer is performed by ordinary CMP after polishing of the wafer with an abrading plate. In FIG. 13, respective components or members are schematically shown. Parts which are not described are the same as in the above first embodiment.

The polishing apparatus in the present embodiment has a pair of polishing sections 130*a* and 130*b* disposed in an opposed manner beside one end of a space on a floor which is rectangular as a whole. Beside the other end of the space, a pair of loading/unloading units bearing cassettes 165*a* and 165*b* accommodating semiconductor wafers are disposed. The two polishing sections 130*a* and 130*b* have devices of basically the same specifications disposed symmetrically (vertically symmetrically in FIG. 13) with respect to the carriage line. Each of the polishing sections 130*a* and 130*b* comprises a turn table 133 pasted with an abrasive cloth or an abrading plate on an upper surface thereof, a polishing unit 137 for holding the semiconductor wafer by vacuum attraction and pressing the semiconductor wafer against a surface of the abrasive cloth or abrading plate for polishing, and a dressing unit 141 for dressing the abrading plate or abrasive cloth. The polishing sections 130*a* and 130*b* each have a work receiving-delivering device 143 at both sides of the carriage line for receiving and delivering the semiconductor wafer from and to the polishing unit 137. On both sides of the carriage line, an inverter 161 and an inverter 163 are disposed. Bilaterally of and adjacent to the inverters 161 and 163, two cleaners 155*a* and 156*a*, and two cleaners 155*b* and 156*b* are disposed, respectively.

In the polishing apparatus shown in FIG. 12, the carrier robots are disposed on a rail, and are movable rightward and leftward. Carrier robots 1, 1 in the present embodiment are fixed. If carriage over a long distance is not necessary, the absence of a rail simplifies the structure of the apparatus. The carrier robots 1, 1 each having an articulated arm bendable in a horizontal plane, and comprise two (upper and lower) grips used differently as dry fingers and wet fingers. In the present embodiment, the right-hand carrier robot 1 in FIG. 13 is basically responsible for the area closer to the cassettes 165*a*, 165*b* relative to the work inverters 161, 163, while the left-hand carrier robot 1 in FIG. 13 is basically responsible for the area closer to the polishing sections 130*a*, 130*b* relative to the work inverters 161, 163.

The type of the cleaner is arbitrary. Examples of the cleaner beside the polishing sections are cleaners 155*a*, 155*b* of the type which wipes the face and back sides of a semiconductor wafer with rollers having sponges. Whereas examples of the cleaner beside the cassettes are cleaners 156*a*, 156*b* of the type which grips the edge of a semiconductor wafer and supplies a cleaning solution to the wafer while rotating it in a horizontal plane. The latter cleaners also have the function of a dryer which dries the wafer while using centrifugal force. In the cleaners 155*a*, 155*b*, primary cleaning of the semiconductor wafer can be performed. In the cleaners 156*a*, 156*b*, secondary cleaning of the semiconductor wafer after primary cleaning can be carried out.

In the polishing apparatus of the foregoing constitution, series processing and parallel processing are both possible. First, an explanation will be offered for series processing (two-stage polishing) in which touch-up polishing is performed after abrading plate polishing. When touch-up polishing is to be implemented after abrading plate polishing according to series processing, a turn table is placed in each of the polishing sections 130*a*, 130*b*. For example, a turn table for abrading plate polishing (primary polishing) is disposed in the polishing section 130*a*, and a turn table for touch-up (secondary polishing) is disposed in the polishing section 130*b*.

In this series processing, the flow of the semiconductor wafer is, for example, as follows: cassette 165*a* → inverter → 161 polishing section 130*a* → cleaner 155*a* → polishing section 130*b* → cleaner 155*b* → inverter 163 → cleaner 156*b* → cassette 165*b*. The carrier robots 1, 1 use the dry fingers when handling a dry semiconductor wafer, but use the wet fingers when handling a wet semiconductor wafer. The work receiving/delivering device 143 receives the semiconductor wafer from the robot 1, and ascends and delivers the semiconductor wafer when the top ring moves upwardly. The semiconductor wafer after polishing is rinsed by a rinse feeder provided at the position of the work receiving/delivering device 143.

With such a polishing apparatus, the semiconductor wafer can be cleaned with the work receiving/delivering device 143 and the cleaner 155*a* in a state separated from the top ring. Thus, abrasive particles, etc. formed by primary polishing (abrading plate polishing) and deposited on the back side and side surface, as well as the polished surface, of the semiconductor wafer can be removed completely. After secondary polishing (touch-up), the semiconductor wafer is cleaned with the cleaners 155*b* and 156*b*, spin dried thereby, and returned to the cassette 165*a*.

Figure 14:
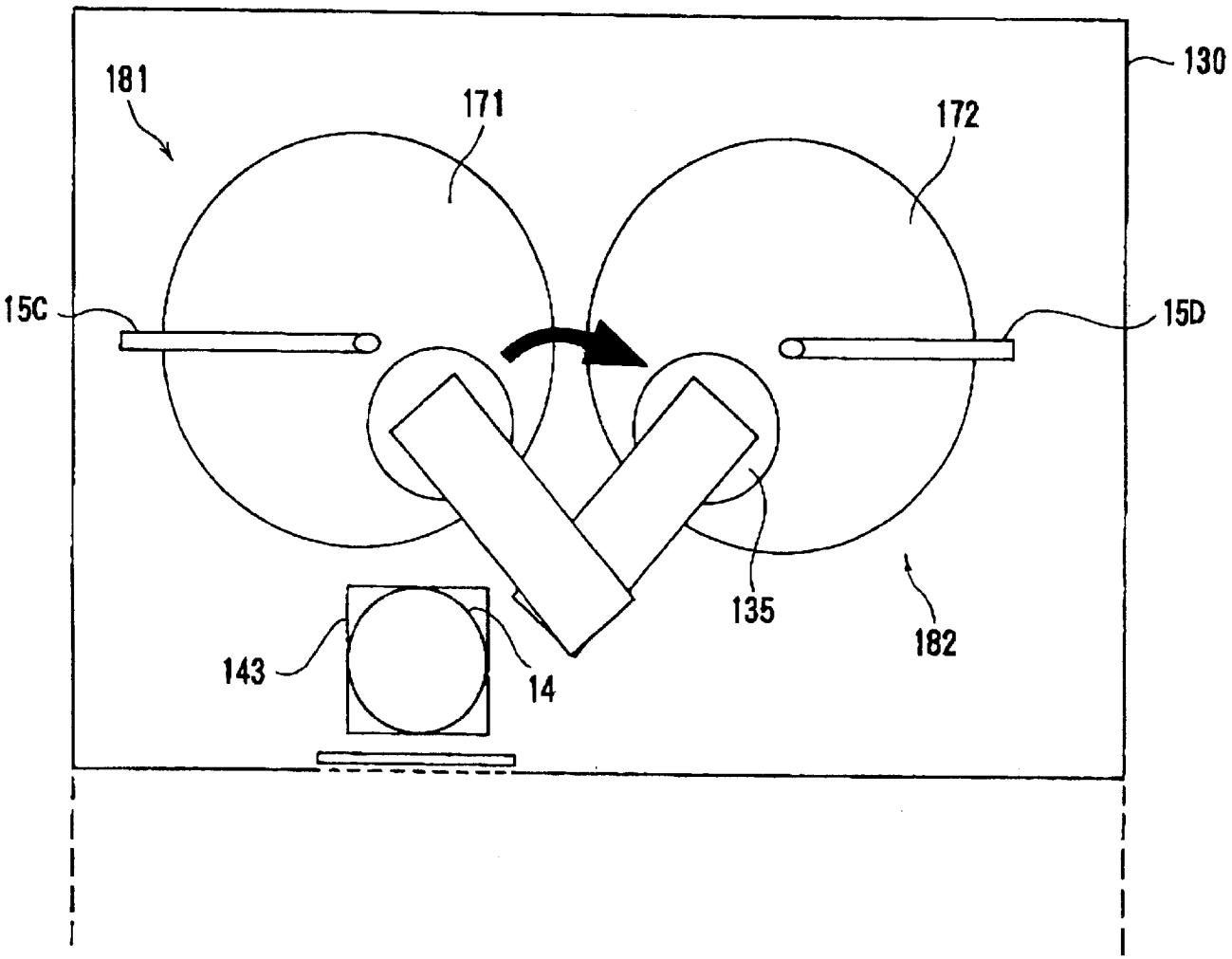
FIG. 14 is a plan view showing an example of a polishing section.
Figure 15:
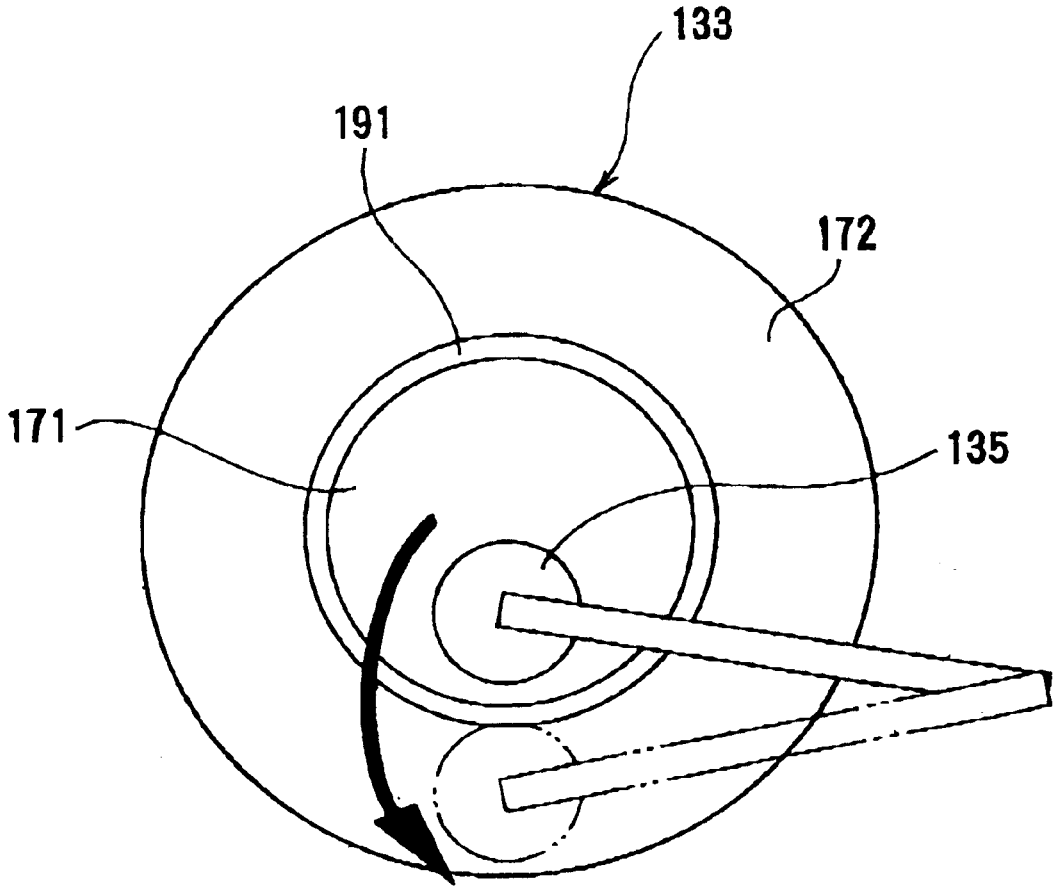
FIG. 15 is a plan view showing another example of the polishing section.
Figure 16:
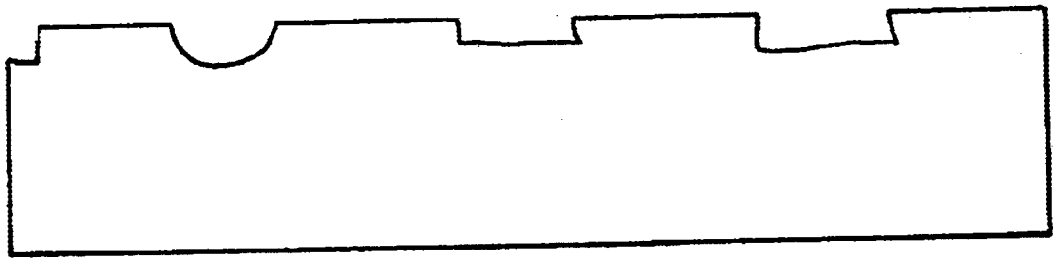
FIG. 16 is a schematic view showing the cross-section of a wafer to be polished.

Next, an explanation will be offered for parallel processing in which touch-up polishing is performed after abrading plate polishing. When touch-up polishing is to be performed after abrading plate polishing by parallel processing, both of abrading plate polishing and touch-up polishing are made possible in each of the polishing sections 130*a* and 130*b*. That is, a turn table for abrading plate polishing and a turn table for touch-up polishing are disposed in one polishing section. FIGS. 14 and 15 show examples in which both of abrading plate polishing and touch-up polishing can be performed in one polishing section.

In FIG. 14, an abrading plate polishing device 181 using an abrading plate 171 and a touch-up device 182 using a polishing cloth 172 are placed side by side in a polishing section 130. In the abrading plate polishing device 181, water or a chemical solution is supplied from a nozzle 15C, and polishing with the abrading plate 171 is performed. In the touch-up device 182, a slurry containing abrasive particles is supplied from a nozzle 15D onto the polishing cloth 172, and chemical and mechanical polishing is performed. A semiconductor wafer 14, an object to be polished, is placed on a work receiving/delivering device 143 in the polishing section 130. The semiconductor wafer 14 is polished with the abrading plate 171 of the abrading plate polishing device 181 until steps on its surface are eliminated and a predetermined film thickness is reached. Then, touch-up polishing is performed by chemical and mechanical polishing of the touch-up device 182 to remove scratches, etc. On the surface. In the example shown in FIG. 14, the polishing table of each of the abrading plate polishing device 181 and the touch-up device 182 is a turn table type polishing table which rotates on its own axis about the center of the polishing table. However, a scroll type polishing table may be used in one of or both of the abrading plate polishing device 181 and the touch-up device 182. The scroll type polishing table makes a translational motion without rotation on its own axis, with a predetermined radius of rotational motion (i.e. a circulating translational motion). This type of polishing table is advantageous in that relative speeds are constant at various points on the polishing table, and the area of table installation is decreased.

In FIG. 15, a polishing cloth 172 and an abrading plate 171 are both provided concentrically on a turn table 133. In the polishing section of this configuration, after completion of polishing with the abrading plate 171, a top ring 135 holding a semiconductor wafer is moved onto the polishing cloth 172, and a polishing slurry is supplied from a nozzle (not shown), whereby touch-up polishing can be performed. By constituting an abrading plate table and a polishing cloth table to be located at the center and on the outer periphery of concentric circles on the same turn table 133, as shown in FIG. 15, there is no need to provide two turn tables, even when touch-up polishing is to be performed after abrading plate polishing. Thus, a space saving is achieved, and only one rotational drive source (motor) for rotationally driving the turn table is also achieved. AS shown in FIG. 15, a discharge groove 191 is provided in the polishing surface of the abrading plate and the polishing surface of the polishing cloth to avoid mixing of liquids used in both types of polishing (i.e., water or chemical solution and slurry).

Although certain preferred embodiments of the present invention have been shown and described in detail, it should be understood that various changes and modifications may be made therein without departing from the scope of the appended claims.

What is claimed is:

1. A method for polishing a device wafer having projections and depressions on a surface thereof, comprising:

subjecting the device wafer to a fixed abrasive while supplying a surface active agent onto a surface of said fixed abrasive, wherein said surface active agent comprises a substance having both a hydrophilic atomic group and a hydrophobic atomic group.

2. The method according to claim 1, wherein supplying a surface active agent onto a surface of said fixed abrasive comprises supplying the surface active agent onto the surface of said fixed abrasive for only a portion of the total time that said device wafer is subjected to said fixed abrasive.

3. The method according to claim 1, further comprising:

dressing said surface of said fixed abrasive.

4. The method according to claim 3, wherein supplying a surface active agent onto a surface of said fixed abrasive comprises supplying the surface active agent onto the surface of said fixed abrasive while dressing of said surface of said fixed abrasive is not being performed.

5. The method according to claim 3, wherein subjecting the device wafer to a fixed abrasive comprises subjecting said device wafer to the fixed abrasive while dressing said fixed abrasive and after dressing of said fixed abrasive is stopped.

6. The method according to claim 1, wherein subjecting the device wafer to a fixed abrasive while supplying a surface active agent onto a surface of said fixed abrasive comprises subjecting said device wafer to the fixed abrasive prior to supplying the surface active agent onto the surface of said fixed abrasive and then beginning supply of said surface active agent onto said surface of said fixed abrasive prior to removal of the projections via the subjecting of the device wafer to the fixed abrasive.

7. The method according to claim 1, wherein subjecting the device wafer to a fixed abrasive comprises subjecting said device Wafer to the fixed abrasive while supplying a chemical solution that contributes to promotion of a chemical reaction.

8. The method according to claim 1, further comprising:

performing touch-up polishing of said device wafer after subjecting said device wafer to said fixed abrasive.

9. The method according to claim 8, wherein performing touch-up polishing of said device wafer comprises subjecting said device wafer to a polishing cloth.

10. The method according to claim 8, wherein performing touch-up polishing of said device wafer comprises subjecting said device wafer to a slurry.

11. An apparatus for polishing a wafer by subjecting the wafer to a fixed abrasive, comprising:

a top ring for holding a wafer;

a table having a fixed abrasive thereon;

a device for promoting polishing of the wafer; and means for suppressing polishing of the wafer.

12. The apparatus according to claim 11, wherein said device for promoting polishing of the wafer comprises one of (i) a dresser which is to perform a dressing operation while subjecting the wafer to said fixed abrasive, and (ii) a device to supply a chemical solution that promotes polishing, and wherein said device for suppressing polishing of the wafer comprises a device to supply a surface active agent, with the surface active agent comprising a substance having both a hydrophilic atomic group and a hydrophobic atomic group.

13. The apparatus according to claim 11, wherein said top ring is constructed and arranged to rotate the wafer about an axis of the wafer, said table is constructed and arranged to rotate said fixed abrasive about an axis of said fixed abrasive, said fixed abrasive is table-shaped, and a size of said table-shaped fixed abrasive and a size of the wafer to be subjected to said table-shaped fixed abrasive have the following relationship $$2Rw>Rf>Rw/2$$

with Rw being a radius of the wafer and Rf being a radius of said table-shaped fixed abrasive.

14. The apparatus according to claim 11, further comprising:

a touch-up device for performing touch-up polishing of said device wafer after subjecting said device wafer to said fixed abrasive.

15. The apparatus according to claim 11, wherein said means for suppressing polishing of the wafer comprises a device for supplying a substance onto a polishing surface of said fixed abrasive so as to lower a polishing speed of the wafer.

16. A method for polishing a wafer, comprising:

subjecting the wafer to a fixed abrasive while dressing said fixed abrasive; and then further subjecting said wafer to said fixed abrasive while not dressing said fixed abrasive.

17. The method according to claim 16, comprising supplying a chemical solution during the further subjecting of said wafer to said fixed abrasive.

18. The method according to claim 17, wherein supplying a chemical solution comprises supplying a surface active agent.

19. The method according to claim 16, further comprising:

finish-polishing said wafer.

20. The method according to claim 19, wherein finish-polishing said wafer comprises subjecting said wafer to a polishing cloth and a slurry.

21. The method according to claim 16, wherein dressing said fixed abrasive results in abrasive particles being released from said fixed abrasive while subjecting said wafer to said fixed abrasive.

22. An apparatus for polishing a wafer by subjecting the wafer to a fixed abrasive, comprising:

a top ring for holding a wafer;

a table having on a surface thereof a fixed abrasive to which the wafer is to be subjected; and a device for supplying a surface active agent onto said fixed abrasive while subjecting the wafer to said fixed abrasive, wherein the surface active agent comprises a substance having both a hydrophilic atomic group and a hydrophobic atomic group.

23. The apparatus according to claim 22, further comprising:

a dresser for dressing said fixed abrasive to increase the amount of abrasive particles on a surface of said fixed abrasive.

* * * * *